United States Patent [19]

Song

[11] Patent Number: 4,752,656

[45] Date of Patent: Jun. 21, 1988

[54] SWITCH DEVICE FOR CONTROLLING THE POWER SUPPLY TO AN ELECTRIC HEATER WITH ONE HEATER

[75] Inventor: Ki W. Song, Seoul, Rep. of Korea

[73] Assignee: Kookje Elec. Ind. Co., Ltd., Seoul, Rep. of Korea

[21] Appl. No.: 5,587

[22] Filed: Jan. 21, 1987

[30] Foreign Application Priority Data

Jan. 24, 1986 [KR] Rep. of Korea ..... 750/1986[U]

[51] Int. Cl.[4] ..... H01H 43/10

[52] U.S. Cl. ..... 200/38 R; 200/38 F

[58] Field of Search ..... 200/35 R, 36, 37 R, 200/37 A, 38 R, 38 A, 38 F, 38 FA, 38 FB, 38 B, 38 BA, 38 C, 38 CA, 39 R, 39 A, 153 L, 153 LB

[56] References Cited

U.S. PATENT DOCUMENTS

| | | | |
|---|---|---|---|
| 2,402,404 | 6/1946 | Hodgkins | 200/38 A |
| 3,047,684 | 7/1962 | Heerdt | 200/39 R X |
| 3,234,805 | 2/1966 | Slonneger | 200/38 C X |
| 3,368,042 | 2/1968 | Lace | 200/38 A |
| 3,823,280 | 7/1974 | Obermann et al. | 200/38 B |
| 4,060,702 | 11/1977 | Linn | 200/38 C X |
| 4,675,478 | 6/1987 | Song | 200/38 R |

*Primary Examiner*—J. R. Scott

*Attorney, Agent, or Firm*—Ostrolenk, Faber, Gerb & Soffen

[57] ABSTRACT

An electric power control switch for controlling heating temperature of a heating element such as an electric heater wherein a triangular cam groove is formed and a timing cam driven by a motor rotates the cam between a stationary piece and a movable piece carrying contacts. The electric power can be turned on and off by controlling the engagement of contacts on the two pieces. The contacts are positioned on contact strips. The cam arrangement includes a contact band-type cam follower for one of the contact strips; the control cam optionally connects electrical contacts for driving the timing cam. A guide pin for the contact carrying strips and the control cam interact to adjust the time period of engagement and disengagement between the contacts for the power supply to a heater by properly setting the timing cam spacing between the contacts for the heater.

5 Claims, 3 Drawing Sheets

FIG, 2
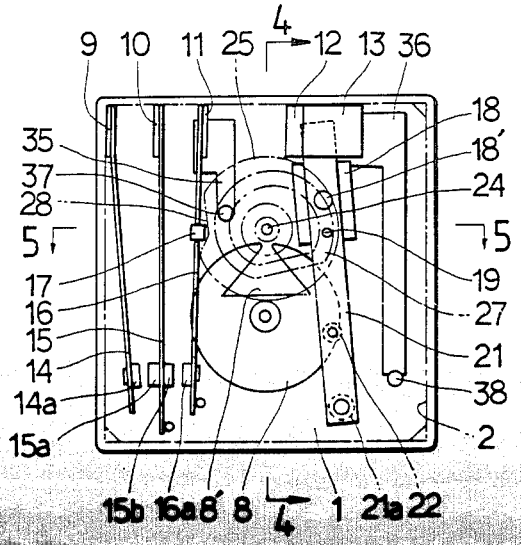
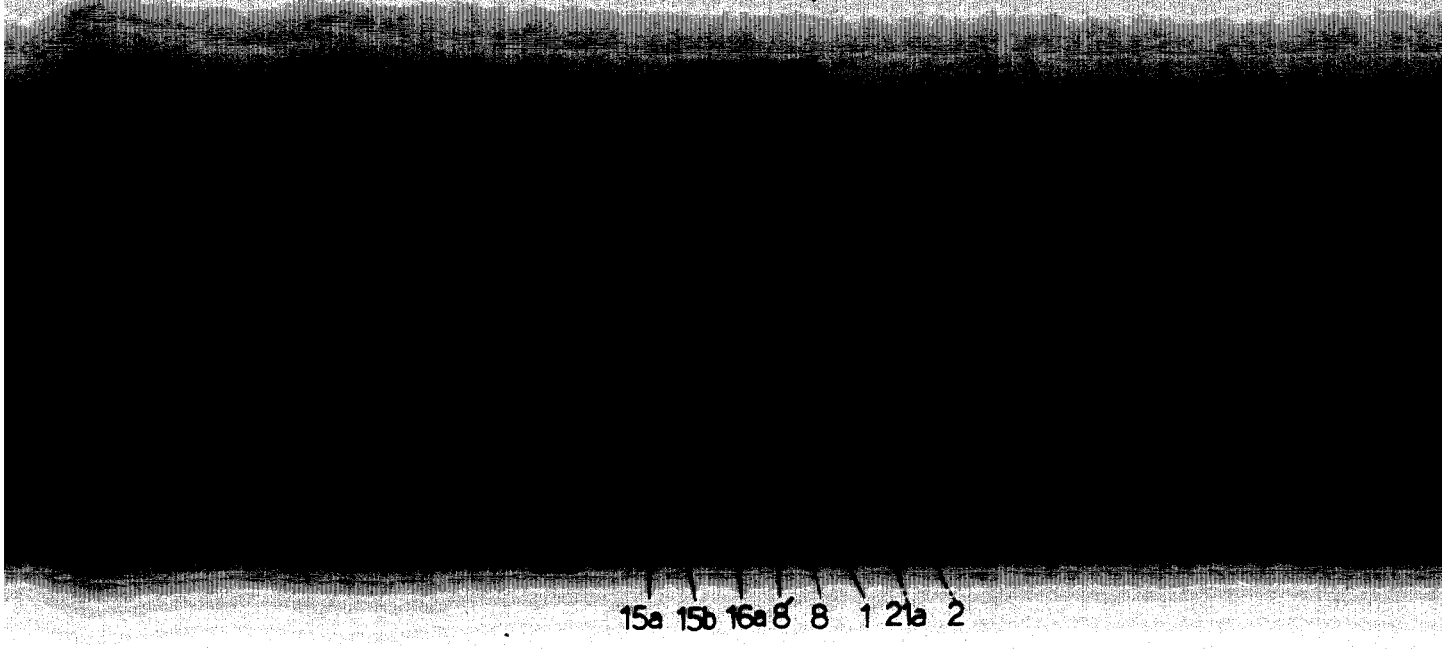

FIG, 4
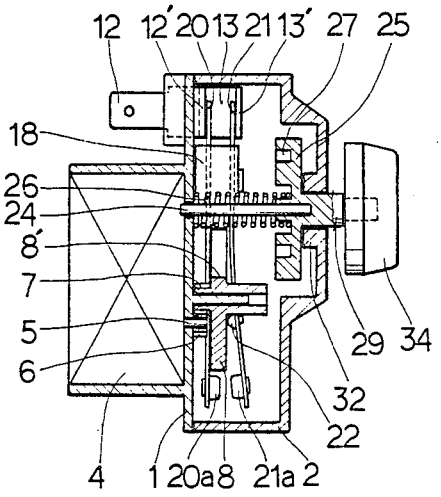
FIG, 5
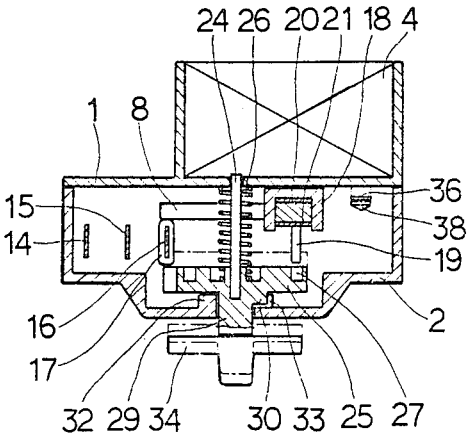
FIG, 6
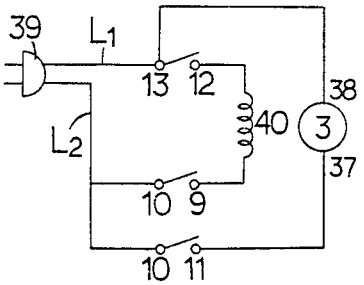

SWITCH DEVICE FOR CONTROLLING THE POWER SUPPLY TO AN ELECTRIC HEATER WITH ONE HEATER

BACKGROUND OF THE INVENTION

This invention relates to an improvement of U.S. Pat. No. 4,675,478 issued June 23, 1987 on an invention by the present applicant, more particularly to an electric power control switch device which is available for controlling a power supply to an electric heater with one heater.

The U.S. Pat. No. 4,675,478 by the present applicant discloses a switch device with timing cam being mounted on a rotary output shaft of a reducer driven by a motor; a first switch means for the power supply to the motor is installed on the upper portion of a housing and having a plurality of limbs, with contact or contacts adapted to be able to contact to one another at their ends, extended from each other; a pair of second switch means for engaging the limbs to detach the contats from one another and for disengaging from the limbs to attach the contacts to one another, with a pair of bars transversely extended from each second switch means having electrical and mechanical contacts thereon; and a timing cam for engaging the mechanical contacts to detach the electrical contacts of the transverse bar from each other and for disengaging from the mechanical contacts to attach the electrical contacts to each other, in order to make a periodical power appliance to each heater.

The switch device disclosed in above U.S. Pat. No. 4,675,478 is preferable to employ on electric heaters with two heaters. In the case of being employed on electric heaters with only one heater, it is undesirable to adapt the above U.S. Pat. No. 4,675,478 requiring great bulk for installation.

OBJECTS OF THE INVENTION

Therefore, it is an object of the invention to provide an electric power control switch which is available for controlling power appliance time to an electric heater with only one heater.

It is another object of the invention to provide an electric power control switch with a small size and with a smooth power control.

BRIEF DESCRIPTION OF THE DRAWINGS

These and other objects and advantages of the invention will become apparent from the following description taken in connection with the appended drawings in which:

FIGS. 2 and 3 are elevational views showing operations of the invention;

FIGS. 4 and 5 are sectional views taken along lines 4—4 and 5—5 of FIG. 2; and

FIG. 6 is a wiring diagram of the electric power control switch according to the invention.

BEST MODE OF CARRYING OUT THE INVENTION

Figure 1:
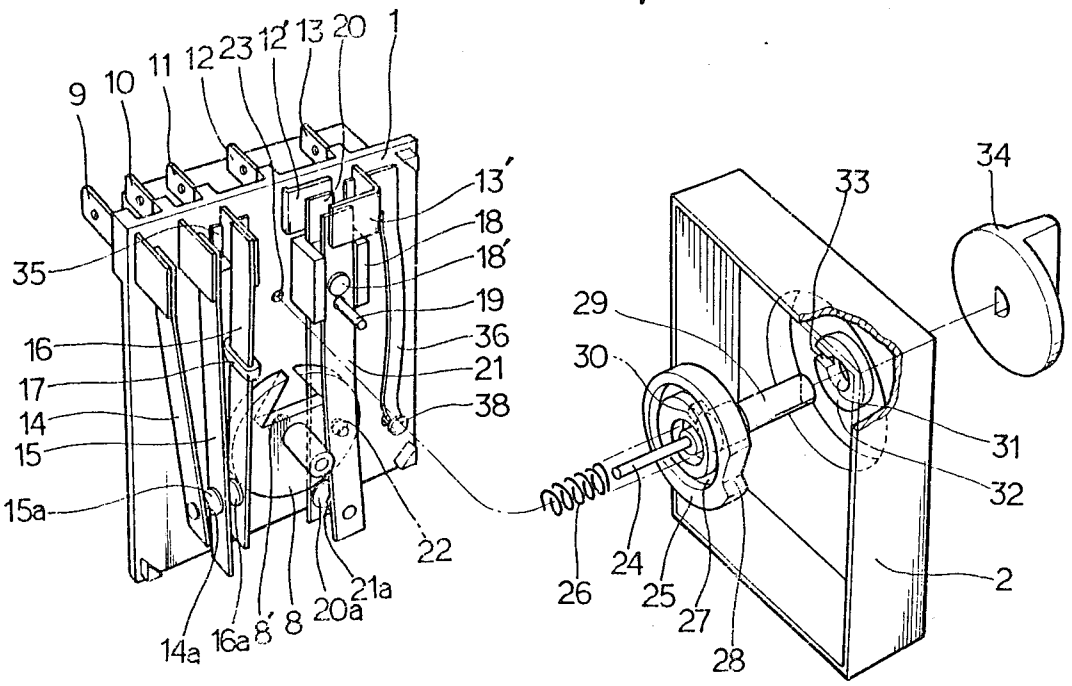
FIG. 1 is a perspective view showing the electric power control switch according to the invention, explosive in part.

Referring to FIGS. 1 to 5, there is illustrated an electric power control switch according to the invention in which a rectangular cover plate 2 is detachably mounted on the front face of a base plate 1 of electrical insulation material, and a reducer 4 having a motor 3 is attached on the rear side of the base plate 1. A rotating shaft 5 of the reducer 4 is extended piercing through the base plate 1, and a gear 6 interlocked with a gear 7 is mounted on a leading end of the rotating shaft 5. The gear 7 is integrated with a circular timing cam 8 formed with a triangular cam groove 8', and thus the timing cam 8 may be rotated according to the rotation of the rotating shaft 5.

Further, provided on the base plate 1 are five contact elements 9,10,11,12 and 13 in predetermined spaced relationship, of which the contact elements 9,10 and 11 are provided with flexible contact strips 14,15 and 16 whose each one end is secured to the corresponding contact element and the other ends are free. And, the contact strip 16 includes a contact band type cam follower 17 around its midpoint.

The free end of the contact strip 15 is provided with contacts 15*a* and 15*b* on its both sides in the positions corresponding to contacts 14*a* and 16*a* of the contact strips 14 and 16, respectively. Also, the contact elements 12 and 13 include folded portions 12' and 13', to which one end portions of stationary and movable pieces 20 and 21 are movably attached. The stationary and movable pieces 20 and 21 are received in a switch holder 18 with a guide pin 19, which is pivotally fixed to the base plate 1 with an axial pin 18', in predetermined spaced relationship. The stationary and movable pieces 20 and 21 are provided with contacts 20*a* and 21*a* at the free end portions thereof, and the movable piece 21 is further provided with a contact protrusion 22. Between the stationary and movable pieces 20 and 21, the timing cam 8 is interposed.

Further, provided on the base plate 1 is an axial orifice 23 adapted to receive a rotating shaft 24 on which a generally-circular control cam 25 with a recess 28 is mounted with a medium of a coil spring 26. The control cam 25 is also formed with a groove 27 of generally involute curvature, along which the guide pin 19 of the switch holder 18 is guided. The recess 28 is positioned on the peripheral surface of the control cam 25 in such a manner that when the guide pin 19 resides in the furthermost portion of the groove 27, the cam follower on the contact strip 16 resides in the recess 28. The control cam 25 is integrated with a control rod 29 which is extended outwardly beyond the cover plate 2 through an opening 31, and on which a control knob 34 is mounted. The control cam 25 is further provided with a protrusion 30 integrated therewith, which is appropriately positioned in such a manner that when the guide pin 19 resides in the furthermost portion of the groove 27, the protrusion 30 is inserted into a concavity 33 formed on an annular hoop 32 surrounding the opening 31.

Referring to FIG. 6, there is shown a wire diagram for showing the electric circuit of the electric power control switch device according to the invention. Reference numeral 39 is an electric plug 39, whose one input line $L_1$ is connected to a terminal 38 of the motor 3 through the contact 21*a* of the contact element 13 and other input line $L_2$ is connected to the contacts 15*a* and 15*b* of the contact element 10 in parallel. The contact 20*a* of the contact element 12 and the contact 14*a* of the contact element 9 are interconnected in series through an electric resistor 40. The other terminal 37 of the motor 3 is connected to the contact 16*a* of the contact element 11. Reference numerals 35 and 36 are electric connecting pieces for applying the power supply fed to the contact elements 11 and 13 to the terminals 37 and 38 of the motor 3.

Hereinafter, the operation of the invention will be described.

According to the control knob 34 being rotated in clockwise or counterclockwise direction, the control cam 25 integrated with the control rod 29 is rotated so that the switch holder 18 may be pivotted with the axial pin 18' in the center, with the guide pin 19 being guided along the groove 27. When the guide pin 19 is located in the furthermost portion of the groove 27, the cam follower 17 resides in the recess 28 of the control cam 25 and the protrusion 30 resides in the recess 33 of the annular hoop 32, as illustrated in FIG. 2. Then, contacts 15*a* and 15*b* of the contact strip 15 and the contacts 14*a* and 16*a* of the contact strips 14 and 16 are detached from one another, and thereby no power supply is applied to the motor 3 and resistor 40 so that the motor 3 and resistor 40 are deenergized, as illustrated in FIG. 6.

If the control knob 34 is properly adjusted and the cam follower 17 is displaced from the recess 28 of the control cam 25, then the contact strip 16 is pushed toward the contact strips 15 and 14 so that the contacts 15*a* and 15*b* of the contact strip 15 and the contacts 14*a* and 16*a* of the contact strips 14 and 16 are attached to one another, as illustrated in FIG. 3. Thereby, the power supply is applied to the motor 3 through the electric plug 39 to energize the motor 3. The rotation of the motor 3 is reduced in velocity through the reducer 4 and transferred to the rotating shaft 5, and thus the gears 6 and 7 are rotated so that the timing cam 8 connected to the gear 7 may be rotated with predetermined velocity.

If since the timing cam 8 is interposed between the stationary and movable pieces 20 and 21 the contact protrusion 22 rides on the surface of the timing cam 8, the contacts 20*a* and 21*a* of the stationary and movable pieces 20 and 21 are detached from each other so that no power supply is applied to the resistor 40. Otherwise, when the contact protrusion 22 is located in the triangular cam groove 8', the movable piece 21 is restored so that the contact 21*a* thereof may be attached to the contact 20*a* of the stationary piece 20 to energize the resistor 40.

Since while the timing cam 8 is rotated the contacts 20*a* and 21*a* repeat the attachment and detachment in predetermined time period, a periodical power supply may be made to the resistor 40 and thus the temperature of the heater may be properly adjusted. The time period of power appliance to the resistor 40 may be readily adjusted by appropriately setting the control cam 25 at proper position. That is, when the contact protrusion 22 of the movable piece 21 is set to reside near the center of the timing cam 8 by the control knob 34, the time of the contact protrusion 22 riding on the timing cam surface becomes shortened and the time of residing in the cam groove 8' becomes lengthened. Thereby, the time of attachment between the contacts 20*a* and 21*a* becomes lenghtened so that the time of power appliance to the resistor 40 may be lengthened. On the contrary, when the contact protrusion 22 is set to reside apart from the center of the timing cam 8, the time of the contact protrusion 22 riding on the timing cam surface becomes lengthened and the time of residing in the cam groove 8' becomes shortened. Thereby, the time of attachment between the contacts 20*a* and 20*b* becomes shortened so that the time of power appliance to the resistor 40 may be shortened.

As set forth hereinabove, the present invention may provide an electric power control switch device which is available for controlling the power supply to an electric heater with one heater.

Having described that the timing cam is provided with a triangular cam groove at its one surface, it will be understood by those skilled in the art that many modifications in its form including other changes in construction of the invention may be made without departing from the scope and spirit of the invention.

I claim:

1. A switch device for controlling the power supply to an electric heater with one heater comprising:

a base plate;

electric contact elements mounted on said base plate in predetermined space relationship to each other;

a plurality of flexible contact strips;

each of said contact strips having one end secured to a respective contact element and the other end free;

the free end of one of said contact strips being provided with contacts at both sides;

the free ends of second and third of said contact strips being provided with contacts at positions corresponding to said contacts of the said one contact strip, the second of said contact strips being provided with a contact band cam follower around its midpoint;

stationary and movable switch pieces, each with one end movably fixed to a folded portion of a respective said contact element and the other end free, the free ends of the switch pieces having respective contacts, said movable switch piece being provided with a contact protrusion;

a switch holder with a guide pin, said switch holder being pivotally fixed to the base plate by an axial pin, said switch pieces being received within said switch holder;

a rotatable timing cam interposed between the switch pieces and connected through gears to a reducer with a motor, said timing cam having a timing cam groove corresponding to a variable duty cycle for the application of power to said heater;

said contact protrusion of said movable switch piece being received within said timing cam groove during a portion of the rotation of the timing cam, allowing the free end of said movable switch piece to move toward the free end of said stationary switch piece, creating electrical contact between the contacts of said movable and stationary switch pieces and closing an electrical circuit so that power is supplied to said electric heater;

said contact protrusion resting on said timing cam during the remaining portion of the rotation of said timing cam, separating the free end of said movable switch piece from the free end of said stationary switch piece, preventing electrical contact between the contacts of said movable and stationary switch pieces and opening an electrical circuit so that power is cut off to said electric heater;

a generally circular control cam mounted on a shaft in rotatable communication with a control knob, said control cam having a recess along a portion of its peripheral surface for receiving said contact band cam follower, and having a guide groove arranged to guide said guide pin of the switch holder, said control cam being rotatable to displace said contact band cam follower from said recess and flex said second of said contact strips toward said first and third of said contact strips to create electrical contact between the contacts at the free ends of said contact strips, thereby energizing a motor to rotate said timing cam; and the rotation of said control cam also pivoting said switch holder and the stationary and movable switch pieces received therein as said guide pin slides within said guide groove of said control cam, the pivoting of said switch pieces varying the duration of said contact protrusion within said timing cam groove in accordance with the shape of said timing cam groove as said timing cam rotates, thereby varying said duty cycle of power applied to said heater.

2. A switch device as set forth in claim 1, wherein the timing cam is generally circular and the cam groove of the timing cam is of generally triangular shape.

3. A switch device as set forth in claim 1, wherein the guide groove of the control cam is formed of an involute curvature.

4. A switch device as set forth in claim 1, wherein the recess of the control cam is so positioned at the peripheral surface of the control cam that said contact band resides in the said recess when the said guide pin resides in the portion of the guide groove furthest from the axis of the control cam.

5. A switch device as set forth in claim 1, wherein the control cam is provided with a protrusion in such a manner that when the said guide pin resides in the portion of the guide groove furthest from the axis of the control cam the protrusion is received in a concavity formed on an annular hoop of a cover plate detachably mounted on the front face of the base plate.

* * * * *